US010569553B2

(12) United States Patent
Strom et al.

(10) Patent No.: US 10,569,553 B2
(45) Date of Patent: Feb. 25, 2020

(54) RESTRAINING A CARRIAGE WITH A CARRIAGE RESTRAINT

(71) Applicant: Hewlett-Packard Development Company, L.P., Houston, TX (US)

(72) Inventors: Eric Berner Strom, Canby, WA (US); John Barker, Vancouver, WA (US); Josh Dankovchik, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,490

(22) PCT Filed: Jan. 20, 2016

(86) PCT No.: PCT/US2016/014045
§ 371 (c)(1),
(2) Date: Mar. 27, 2018

(87) PCT Pub. No.: WO2017/127063
PCT Pub. Date: Jul. 27, 2017

(65) Prior Publication Data

US 2018/0264825 A1 Sep. 20, 2018

(51) Int. Cl.

| | |
|---|---|
| ***B41J 2/165*** | (2006.01) |
| ***B41J 2/175*** | (2006.01) |
| ***B41J 29/02*** | (2006.01) |
| ***B41J 29/38*** | (2006.01) |

(52) U.S. Cl.
CPC ..... *B41J 2/16544* (2013.01); *B41J 2/16538* (2013.01); *B41J 2/175* (2013.01); *B41J 29/02* (2013.01); *B41J 29/38* (2013.01)

(58) Field of Classification Search
CPC . B41J 2/16535; B41J 2/16538; B41J 2/16544
See application file for complete search history.

(56) References Cited

U.S. PATENT DOCUMENTS

| | | | | |
|---|---|---|---|---|
| 6,030,067 | A | 2/2000 | Kawamura | |
| 6,109,725 | A | 8/2000 | Saikawa et al. | |
| 6,416,161 | B1 | 7/2002 | Berg et al. | |
| 6,578,949 | B2 | 6/2003 | Takahashi et al. | |
| 6,991,312 | B2 | 1/2006 | Uwagaki et al. | |
| 7,052,106 | B1 | 5/2006 | Onuma et al. | |
| 8,398,205 | B2 | 3/2013 | Roth et al. | |
| 2005/0179713 | A1 | 8/2005 | Waller et al. | |
| 2007/0077108 | A1* | 4/2007 | Kawasaki | B41J 29/13 400/625 |
| 2007/0085875 | A1* | 4/2007 | Shimazaki | B41J 2/16511 347/32 |
| 2009/0174748 | A1 | 7/2009 | Balcan et al. | |

(Continued)

FOREIGN PATENT DOCUMENTS

EP 0913264 1/1999

*Primary Examiner* — Scott A Richmond
(74) *Attorney, Agent, or Firm* — Fabian VanCott

(57) ABSTRACT

Restraining a carriage includes a carriage restraint to secure the carriage of a printer, wherein the carriage restraint moves between an engaged position and a disengaged position and an engagement assembly to selectively move the carriage restraint between the engaged position and a disengaged position in between printing operations.

19 Claims, 13 Drawing Sheets

(56) References Cited

U.S. PATENT DOCUMENTS

2011/0316928 A1* 12/2011 Roth ..... B41J 2/16547
347/33
2012/0224002 A1* 9/2012 Yamamoto ..... B41J 2/16523
347/30

* cited by examiner

RESTRAINING A CARRIAGE WITH A CARRIAGE RESTRAINT

BACKGROUND

Printers provide a user with a physical copy of a document. The physical copy is a physical representation of digital data that is printed onto a print medium. The printer, such as a dimensional (2D) printer, includes a number of components such as a carriage and pens. The pens are used to eject printing fluid or other printable material onto the print medium to form an image or text and the carriage houses the pens. The carriage retains the pens and moves along a rod via a motor to position the pens to eject the printing fluid onto the print medium to form an image or text. In some examples, the printer may be a 3 dimensional (3D) printer. A 3D printer uses pens to print on a bed of build material to create a 3D object.

BRIEF DESCRIPTION OF THE DRAWINGS

The accompanying drawings illustrate various examples of the principles described herein and are a part of the specification. The illustrated examples are given merely for illustration, and do not limit the scope of the claims.

FIGS. 7A-7C are views of a system for restraining a carriage and for wiping pens of the carriage, according to one example of principles described herein.

Throughout the drawings, identical reference numbers designate similar, but not necessarily identical, elements.

DETAILED DESCRIPTION

Figure 1:
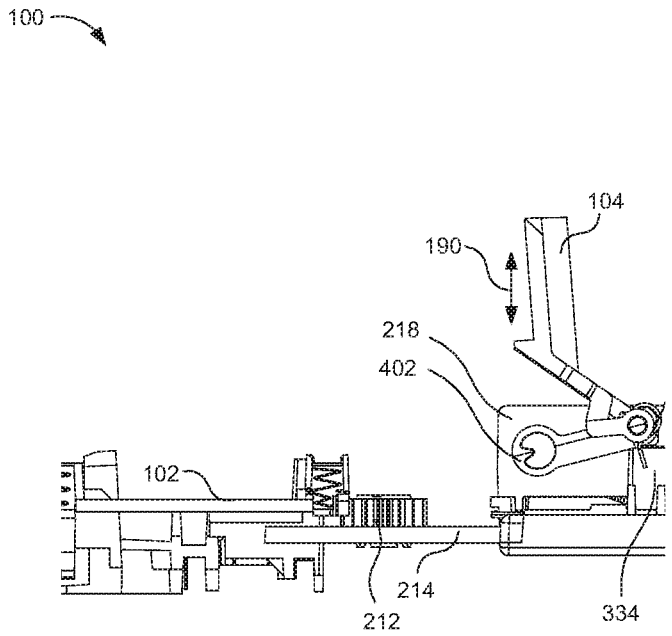
FIG. 1 is side view of a system for restraining a carriage, according to one example of principles described herein.

Printers provide a user with a physical copy of a document by printing a hardcopy of a digital representation of the document onto a print medium. The printer includes a number of components such as a carriage with pens. The pens are used to eject printing fluid or other printable material onto the print medium to form an image. The carriage holds the pens and moves them relative to the print medium such that the printing fluid disposed in the pens can be properly deposited on the print medium to form the image. The carriage is moved relative to the print medium by a motor and is guided by a rod. In other words, the carriage moves along the rod. While such a system is useful in depositing a printing fluid onto a print medium, some aspects of the system complicate its implementation. For example, the components of the printer can be subjected to external forces. For example, during manufacturing and shipping when the carriage is in a capped position to protect and preserve the pens, the printer is loaded, dropped, or otherwise handled. Such handling can cause the carriage to unintentionally move out of the capped position along the rod. Such unintentional movement of the carriage along the rod can damage the carriage or other components in the system. In one scenario, the printer may not be able to print if the carriage is significantly damaged.

To reduce the damaging effects of such external forces, the carriage is restrained using packing materials, such as tape, cardboard, extruded polystyrene foam, or molded disposable parts during shipping of the printer. Once the printer is purchased by a consumer, the consumer removes these packing materials to free the carriage so the carriage can move along the rod during the printing process. However, using these types of packing materials to restrain the carriage can be problematic if they are not used correctly. Further, the cost of the packing materials is passed along to the consumer at time of purchase, which may lead to consumer dissatisfaction and an ultimate loss in sales. Still further, as the packing materials are removed by a consumer, the carriage can still be damaged if the printer is dropped or the carriage is handled by the consumer after the consumer has removed the packing materials.

Accordingly, the principles described herein include a system for restraining a carriage that alleviates these and other complications. Such a system includes a carriage restraint to secure the carriage of a printer, wherein the carriage restraint moves between an engaged position and a disengaged position. The system also includes an engagement assembly to selectively move the carriage restraint between the engaged position and the disengaged position, for example in between printing operations.

The principles described herein include a system for raising and lowering a carriage restraint and a wiper blade. Such a system includes a carriage restraint to selectively secure the carriage by moving between a disengaged position and an engaged position, a wiper blade to wipe the pens, and an engagement assembly to selectively move the carriage restraint between the engaged position and the disengaged position, and selectively move the wiper blade between an engaged position and a disengaged position.

The principles described herein include a method for restraining a carriage. Such a method includes coupling a second rack to a first rack via a gear, wherein a movement in a first direction of the first rack translates to a movement of the second rack in a second direction. The method also includes coupling a carriage restraint and a wiper blade to the second rack such that movement of the second rack along the second direction moves the carriage restraint and the wiper blade in a third direction. Upon receiving a request, a slider is decoupled from the second rack such that the carriage restraint is moved to a disengaged position, the wiper blade remains in an engaged position via a trigger engaged with a latch of a slider, and a shaft is rotated. The rotation of the shaft causes a cam of the shaft to disengage the trigger from the latch such that the slider retracts and moves the wiper blade from the engaged position to a disengaged position.

Such a system allows the carriage of the printer to be restrained before shipping, before a print job, and after a print job such that movement of the carriage is restricted when not in use. As a result, the reliability of the printer is increased because the carriage is less likely to be damaged when the printer is shipped, dropped, or handled by a user. The system further saves time and material at time of manufacture by replacing the throwaway packing materials. Even further, the system reduces stress and torque needs for the carriage.

In the present specification and in the appended claims, the term "disengaged position" refers to a position of the carriage restraint wherein the carriage is free to move, or when referring to a wiper blade, refers to a position of the wiper blade wherein the wiper blade will not interact with a pen that passes by.

In the present specification and in the appended claims, the term "engaged position" refers to a position of the carriage restraint wherein the carriage is not free to move, or when referring to a wiper blade, refers to a position of the wiper blade wherein the wiper blade will interact with a pen that passes by.

In the present specification and in the appended claims, the term "restraint assembly" refers to a mechanism to selectively secure a carriage of a printer.

In the present specification and in the appended claims, the term "engagement assembly" refers to a mechanism to raise or lower the carriage restraint.

In the present specification and in the appended claims, the term "wiper assembly" refers to a mechanism to wipe pens of a printer.

In the present specification and in the appended claims, the term "wiper engagement assembly" refers a mechanism to raise or lower a wiper blade.

Further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Referring now to the figures, FIG. 1 is a side view of a system (100) for restraining a carriage, according to one example of principles described herein. The system (100) includes a carriage restraint (104). The carriage restraint (104) secures a carriage of a printer. The carriage restraint (104) moves between an engaged position and a disengaged position as indicated by arrow (190). In the engaged position, the carriage restraint (104) restrains the carriage. In the disengaged position, the carriage restraint (104) does not restrain the carriage such that the carriage can move freely. More information about the carriage restraint (104) is described below.

The system (100) includes an engagement assembly. In an example, the engagement assembly includes a first rack (102) coupled to a second rack (214) via a gear (212). The movement of the first rack (102) is transferred to the second rack (214) via the gear (212). The engagement assembly selectively moves the carriage restraint (104) between the engaged position and the disengaged position in between printing operations. As described below, a ramp (334) is coupled to the second rack (214). When the second rack (214) moves, the ramp (334) moves the carriage restraint (104) between the engaged position and the disengaged position.

Figure 2A:
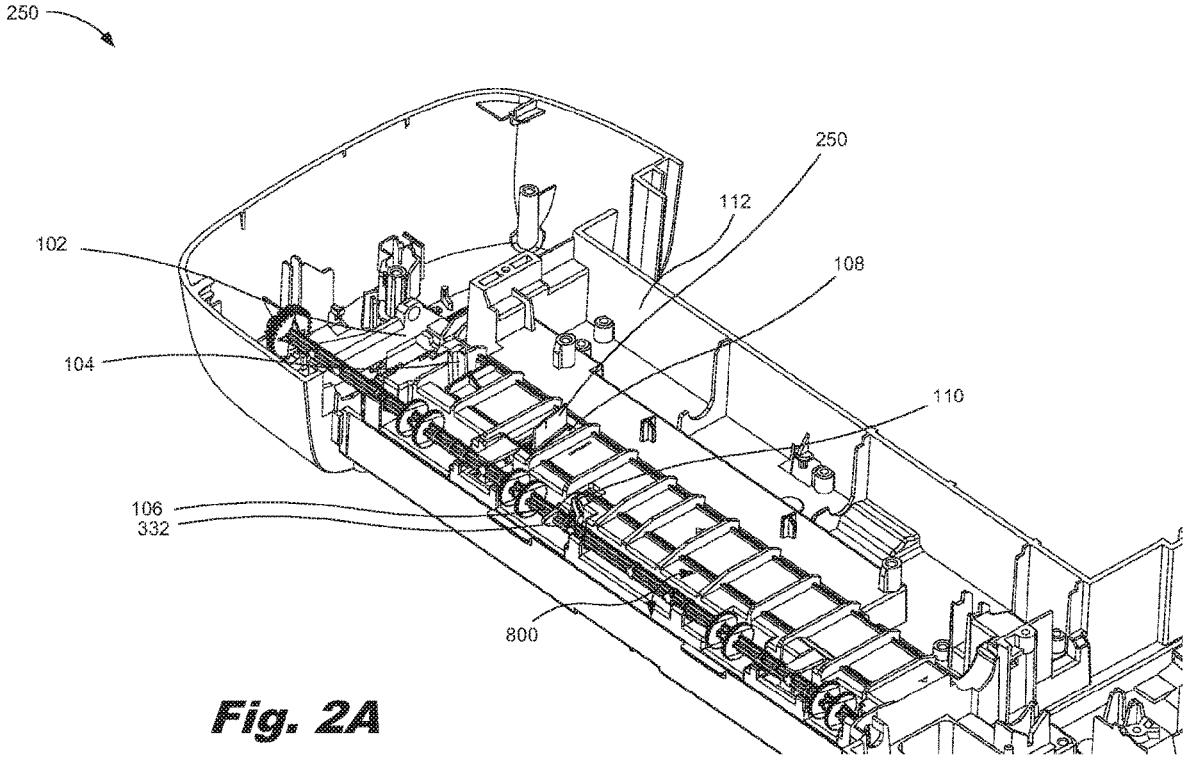
FIGS. 2A-2B are isometric views of a system for restraining a carriage and for wiping pens of the carriage, according to one example of principles described herein.

FIG. 2A is an isometric view of a system for restraining a carriage, according to one example of principles described herein. The system includes a number of components for restraining a carriage and wiping pens of the carriage.

The system (100) includes a base (112). The base (112) is a component of a printer that houses a restraint assembly and a wiper assembly. The base (112) also houses other components or systems of the printer. For example, the base (112) is a housing, and in some cases a mount for a motor, such as a paper motor or a carriage motor, which motors drive components of the printer. The base (112) also houses a carriage, a rod, electronic circuit boards, or other components and/or systems. While specific reference is made to particular components of a printer, the base (112) may house any number and any type of component used in a printer or other printing system.

The system (100) includes a first rack (102). The first rack (102) drives various components for restraining a carriage and wiping pens of the printer. The first rack (102) includes a number of teeth on a shaft. The number of teeth interact with other components to impart motion to those components. For example, the teeth of the first rack (102) enmesh with teeth of a gear (FIG. 1, 212) to convert translational motion of the first rack (102) into rotational motion of the gear (FIG. 1, 212).

Although not illustrated, the first rack (102) is connected to a motor that drives the first rack (102) along a direction of motion. For example, when the motor rotates in one direction, the motor engages with the first rack (102) to move the first rack (102) from a backward position to a forward position. When the motor rotates in a second, and opposite direction, the first rack (102) moves from the forward position to a backward position.

The system (100) also includes the carriage restraint (104). The carriage restraint (104) restrains the carriage of the printer. For example, a post of the carriage restraint (104) interacts with a corresponding portion of the carriage to prevent the carriage from moving. As a result, the carriage restraint (104) prevents the carriage containing the printing pens from moving. By restraining the carriage, the reliability of the printer is increased as the carriage is less likely to be damaged when the printer is shipped, dropped, or handled by a user. The carriage restraint (104) also saves time and material at time of manufacture by replacing the throwaway packing materials.

The carriage restraint (104) selectively restrains the carriage. That is, in one mode of operation, the carriage restraint (104) restrains movement of the carriage, while in another mode of operation does not restrain the carriage from moving. The carriage restraint (104) restrains such motion by moving between a disengaged position and an engaged position. For example, when the carriage restraint (104) is in the disengaged position, the carriage restraint (104) does not restrain the motion of the carriage. As a result, the carriage is free to move along a rod of the printer. The carriage restraint may be in such a disengaged position for example, during execution of a print job. However, when the carriage restraint (104) is in the engaged position, the carriage restraint (104) restrains the carriage. As a result, the carriage does not move along the rod of the printer. This prevents the carriage from becoming damaged if the printer is dropped or the carriage is handled by the consumer.

The system (100) also includes a wiper blade (108). Similar to the carriage restraint (104), the wiper blade (108) is moved between an engaged position and a disengaged position. The wiper blade (108) wipes pens of the carriage. More specifically, the wiper blade (108) wipes excess material such as ink off of the pens of the carriage. The wiper blade (108) may be made out of flexible material such as rubber. This allows the wiper blade (108) to contact the pens for cleaning purposes without damaging the pens. As illustrated in other figures, to wipe the pens of the printer, the wiper blade (108) is moved from a disengaged position to an engaged position via a slider ramp (410). In the engaged position, a tip (250) of the wiper blade (108) makes contact with the pens as the carriage moves back and forth along the rod. This cleans the pens by wiping coagulated printing fluid and/or debris from the pens. When in the disengaged position, the tip (250) of the wiper blade (108) does not make contact with the pens as the carriage moves back and forth along the rod. As a result, the printer executes a print job without the wiper blade (108) wiping the pens.

The system (100) also includes a trigger (110) that maintains the wiper blade (108) in the engaged position when the trigger (110) is engaged with a latch (330). However, when the trigger (110) is disengaged from the latch (330), the wiper blade (108) moves to the disengaged position.

The system (100) also includes a shaft (106). The shaft (106) rotates about an axis as indicated by arrow 800. In an example, the shaft includes a cam (332). As illustrated in other figures, the cam (332) of the shaft (106) disengages the trigger (110) from the latch to allow the slider (216) to retract and to move the wiper blade (108) from the raised position to the lowered position. More information about the cam (332) is described below.

Figure 2B:
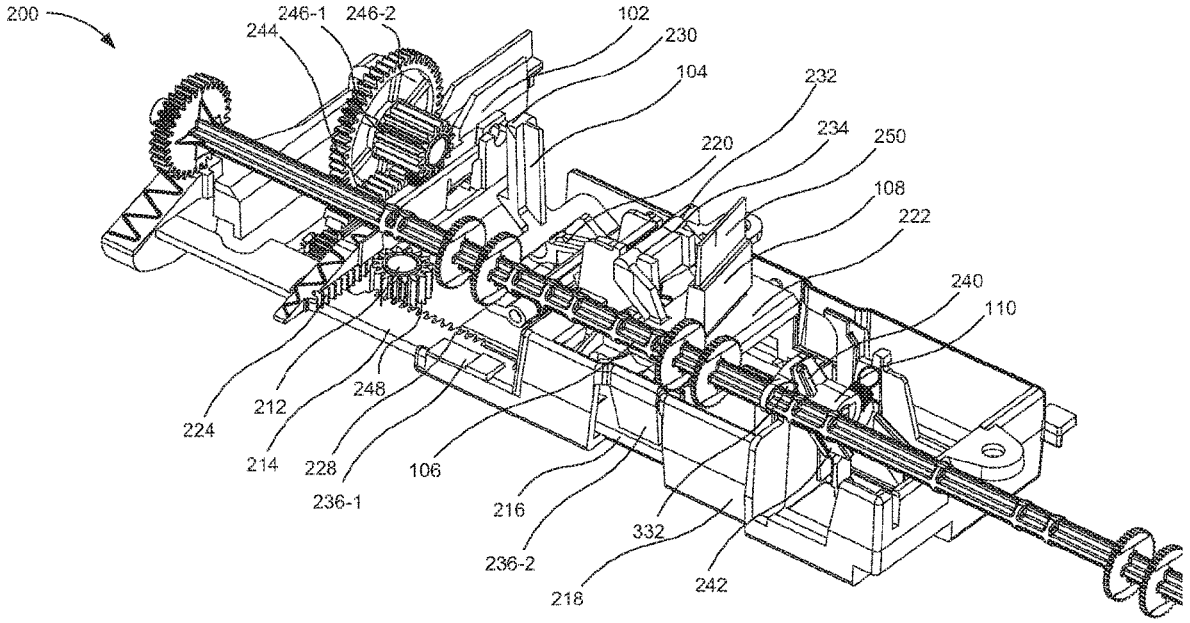

FIG. 2B is an isometric view of a system (200) for restraining a carriage and wiping pens of the carriage, according to one example of principles described herein.

As illustrated, the system (200) includes a frame (218). The frame (218) secures components of the system (200) such that the components interact with each other as intended. For example, the frame (218) secures components such as a carriage restraint (104), a wiper blade (108), and other components described herein. The frame (218) includes a number of retaining brackets (236). For example, the frame (218) includes a rack retaining bracket (236-1) and a slider retaining bracket (236-2). The rack retaining bracket (236-1), as illustrated in FIG. 2B, contacts a second rack (214) and guides the motion of the second rack (214). Similarly, the slider retaining bracket (236-2), as illustrated in FIG. 2B, contacts a slider (216) and guides the motion of the slider (216).

The system (200) also includes the first rack (102). The first rack (102) translates between different positions along a direction of motion. As described above, the first rack (102) includes a number of first rack teeth (224) that engage with gear teeth (248) of a gear (212). Via the teeth (224, 248) enmeshing, the linear motion of the first rack (102) is converted to rotational motion at the gear (212).

Further, the first rack (102) includes other rack teeth (244) that engage with teeth of a first shaft gear (246-1). The first shaft gear (246-1) is connected to a second shaft gear (246-2) as illustrated in FIG. 2B. As a result, if the first shaft gear (246-1) rotates, the second shaft gear (246-2) also rotates. The teeth of the second shaft gear (246-2) engage with teeth on the shaft (106). Accordingly, the linear motion of the first rack (102) is converted to rotational motion at the shaft gears (246). The rotational motion of the shaft gears (246) is transferred to the shaft (106) via enmeshing of the teeth of the shaft gears (246) and the teeth of the shaft (106).

Returning to the first rack (102) and the gear (212), the first rack (102) is coupled to a second rack (214) by way of the gear (212). The second rack (214) converts the rotational motion of the gear (214) into linear motion. For example, the second rack teeth (228) of the second rack (214) engage with the gear teeth (248) of the gear (212). Accordingly, via the first rack (102), the gear (212) and the second rack (214), linear motion is converted from one direction to another.

As will be described below, the linear motion of the second rack (214) moves components, specifically the carriage restraint (104) and the wiper blade (108) between engaged and disengaged positions.

The system (200) includes a restraint assembly to selectively secure a carriage of a printer. The restraint assembly includes the above describe carriage restraint (104). When the carriage restraint (104) is in an engaged position, a portion of the carriage restraint (104) contacts the carriage, when the carriage is in a capping position. In one example, the carriage is in a capping position when a left portion of the carriage is contacting, or is in close proximity to a left side of the base (112), when a capping mechanism is located on the left side of the printer. In another example, the carriage is in a capping position when a right portion of the carriage is contacting, or is in close proximity to a right side of the base (112), when the capping mechanism is located on the right side of the printer. As a result, the contact portion (230) of the carriage restraint (104) contacts the right portion or the left portion of the carriage depending on the location of the capping mechanism.

The restraint assembly further includes a carriage restraint lever (220). As the second rack (214) moves from a first position to a second position, the carriage restraint lever (220) makes contact with and engages with a ramp (334) in FIG. 3. As the carriage restrain lever (220) engages with the ramp (334), the carriage restraint lever (220) acts as a pivot for the carriage restraint (104). This allows the carriage restraint (104) to move between an engaged and a disengaged position. When the second rack (214) is in a first, disengaged position, the ramp (334) does not make contact with the carriage restraint lever (220). When the second rack (214) is in a second, engaged position, the ramp (334) makes contact with the carriage restraint lever (220) moving the carriage restraint (104) from the disengaged position to the engaged position.

The system (200) includes a wiper assembly. The wiper assembly is used for wiping pens of the printer. For example, as the printer executes print jobs, the pens can become clogged with coagulated printing fluid and/or debris such as paper dust. The coagulated printing fluid and/or debris causes the image that the printer is forming to become distorted. As a result, the pens of the printer need to be clean to ensure that the image the printer is forming does not become distorted.

The wiper assembly includes a wiper blade mount (222). The wiper blade mount (222) pivotally secures the wiper blade (108) to the frame (218). The wiper blade mount (222) is secured to the frame (218) via a pivot arm (234) pivotally connected to a receiving notch (232) of the frame (218). In an example, the receiving notch (232) is sized to retain the pivot arm (234). Once the pivot arm (234) is retained by the receiving notch (232) the wiper blade mount (222) pivots to allow the wiper blade (108) to move between the disengaged position and the engaged position.

In some examples, the system (200) includes a wiper engagement assembly. The wiper engagement assembly includes the slider (216) that is slidably coupled to the second rack (214) or is coupled via a number of nesting features in the slider (216) and the second rack (214). As the second racks (214) moves from a first positon to an engaged position, i.e., along the path indicated by the arrow 806 in FIG. 3, the second rack (214) pushes against the slider (216) to move the slider (216) from an unlatched position to a latched position.

When the slider (216) is moved from the unlatched position to the latched position, a slider ramp (410) engages with the wiper blade mount (222) pushing the wiper blade (108) to the engaged position. Further, a latch (330) coupled to the slider (216) engages with a trigger (110) via a pivot arm (242) to retain the slider (216) in the latched position. As a result, the wiper blade (108) remains in the engaged position because the slider ramp (410) is engaged with the wiper blade mount (222). As will be described below, the latch (330) of the slider (216) disengages from the trigger (110) when a cam (332) contacts a portion (240) of the trigger (110). Once the trigger (110) is disengaged from the latch (330), a slider retract spring (328) retracts the slider (216) to the unlatched position. With the slider (216) in the unlatched position, the slider ramp (410) is disengaged from the wiper blade mount (222). This moves the wiper blade (108) from the engaged position to the disengaged position.

Figure 3:
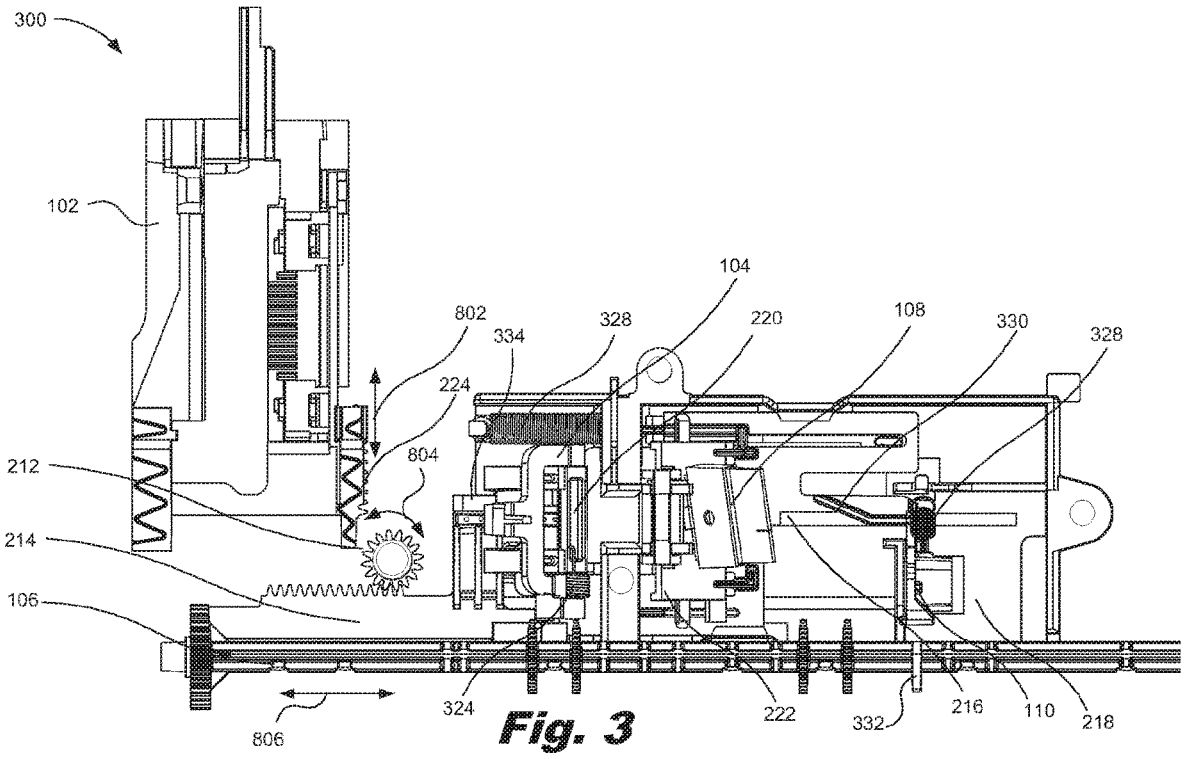
FIG. 3 is a top view of a system for restraining a carriage and for wiping pens of the carriage, according to one example of principles described herein.

FIG. 3 is a top view of a system (300) for restraining a carriage and wiping pens of the carriage, according to one example of principles described herein.

As can be seen in FIG. 3, the first rack (102) moves along a direction indicated by the arrow 802. When the first rack (102) is at the forward position or the backward position, the first rack (102) disengages from the gear (212). More specifically, the first rack teeth (224) on the first rack (102) span a portion of the overall length of the first rack (102). As a result, if the first rack (102) is moved past the forward position or the backward position, the first rack teeth (224) on the first rack (102) no longer engage with the teeth (248) on the gear (212). This allows the printer to execute other functions associated with the first rack (102) without engaging the gear (212).

FIG. 3 also illustrates the interaction between the first rack teeth (224) of the first rack (102) and the gear teeth (248) of the gear (212), the linear motion of the first rack is converted into rotational motion at the gear as indicated by the arrow 804.

FIG. 3 further illustrates the interaction between the gear (212) and the second rack (214) to transfer rotational motion at the gear (212) to translational motion along a direction indicated by the arrow 806. In some examples, the linear motion of the first rack (102) is perpendicular to the linear motion of the second rack (212). This allows the motion to be transferred from one direction to another direction, thus reducing the amount of space needed by the components within the printer.

The system (300) also includes a return spring (324). The return spring (324) is located between a carriage restraint lever (220) and the carriage restraint (104). The return spring (324) returns the carriage restraint (104) from the engaged position to the disengaged position when the second rack (214) is in the first position.

The system (300) also includes a slider retract spring (328). The slider retract spring (328) is used to retract the slider (216) from a latched position to an unlatched position when the trigger (110) disengages from the latch (330). In the unlatched position, the trigger (110) is not engaged with the latch (330). In the latched position, the trigger (110) is engaged with the latch (330). For example, as the slider (216) moves from the unlatched position to the latched position, the slider retract spring (320) stretches from a relaxed position to a tension position. In the relaxed position, the slider retract spring (320) does not apply a force to the slider (216). However, in the tension position, the slider retract spring (320) applies a force to the slider (216). This force is applied in the opposite direction of movement that the slider (216) is moving in when moving from the unlatched position to the latched position. When the slider (216) is in the latched position, the slider retract spring (320) is in the tension position, providing a force capable of retracting the slider back to the unlatched position when the trigger (110) releases the latch (330) and the second rack (214) is in the first position.

Figure 4A:
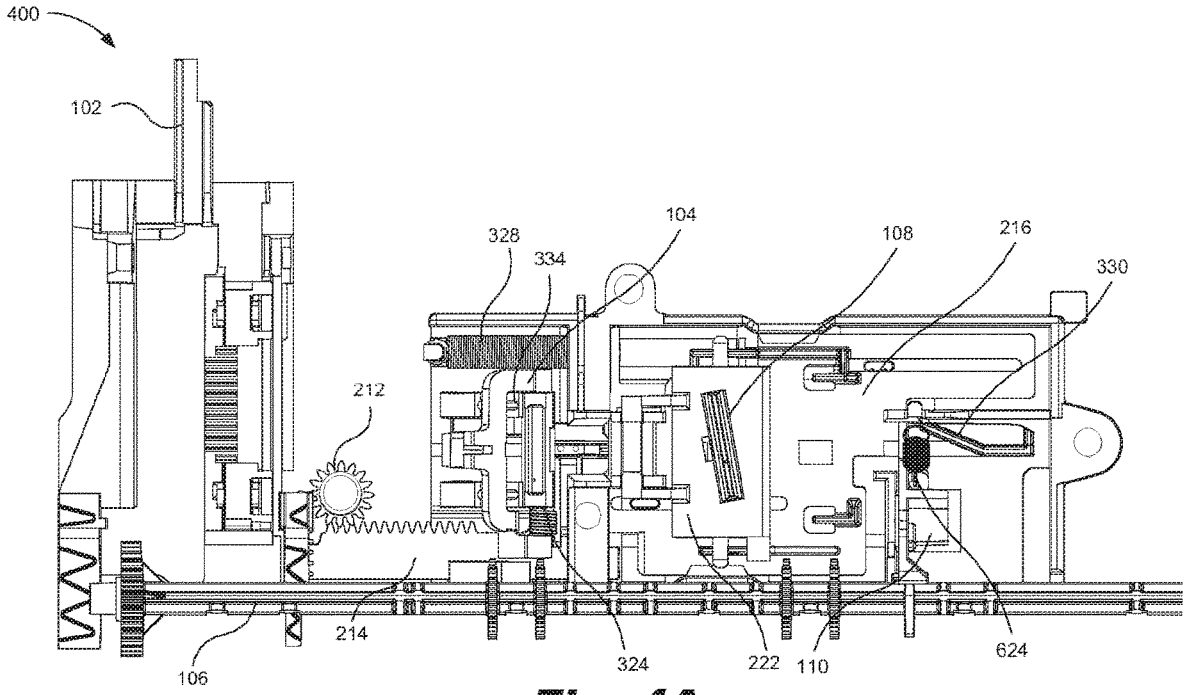
FIGS. 4A-4B are views of a system for restraining a carriage and for wiping pens of the carriage with a carriage restraint in an engaged position and a wiper blade in an engaged position, according to one example of principles described herein.

FIG. 4A is a top view of a system (400) for restraining a carriage and wiping pens of the carriage with a carriage restraint in an engaged position and a wiper blade in an engaged position, according to one example of principles described herein.

To put the carriage restraint (104) and the wiper blade (108) in the engaged position, the first rack (102) has moved to a forward position. The first rack (102) in the forward position positions the second rack (214) in a second position. In the second position, the second rack (214) has moved the ramp (334) under the carriage restraint (104). By moving the ramp (334) under the carriage restraint (104), the carriage restraint (104) is now in the engaged position. In this engaged position, the carriage restraint (104) interacts with a carriage to restrain the carriage.

Further, in the second position, the second rack (214) has pushed against a slider (216). In the second position, the second rack (214) has moved the slider ramp (410) under the wiper blade mount (222) by pushing the slider (218) from an unlatched position to a latched position. By moving the slider ramp (410) under the wiper blade mount (222), the wiper blade mount (222) pivots as described above and the wiper blade (108) is now in an engaged position. In the engaged position, the wiper blade (108) can wipe pens of a printer.

Further, in the engaged position, the second rack (214) has engaged the latch (330) with the trigger (110) as illustrated in FIG. 4A. This retains the slider (218) in the latched position. As a result, regardless of if the second rack (214) is in the first position or the second position, the slider (218) remains in the latched position.

Figure 4B:
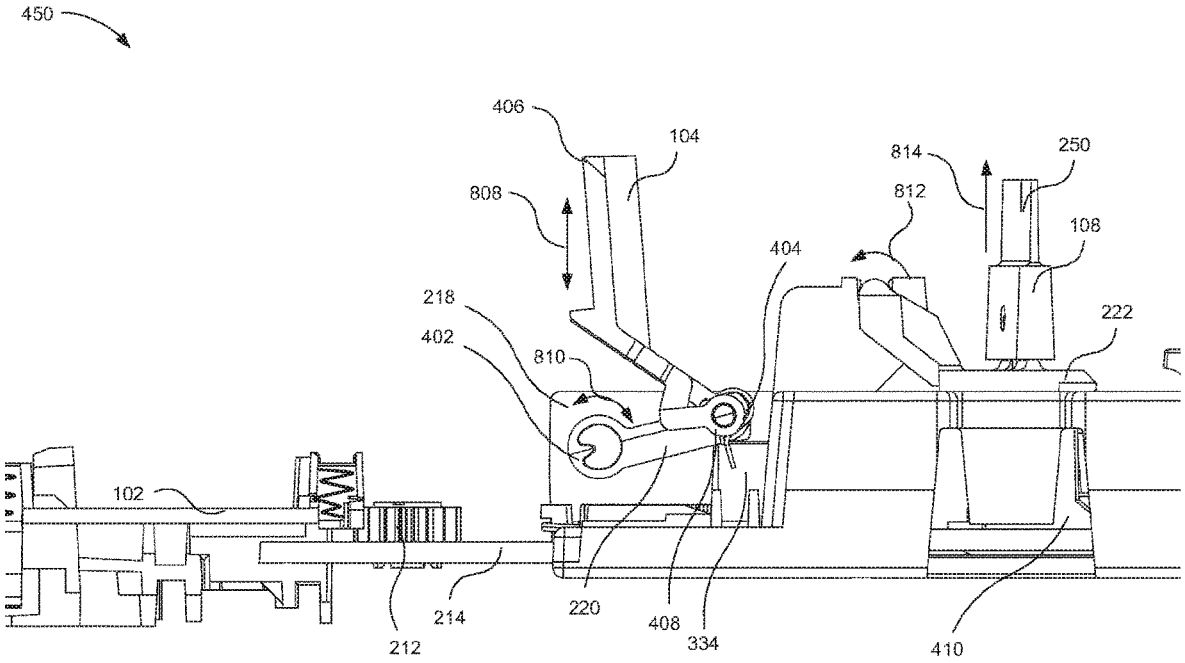

FIG. 4B is a side view of a system for restraining a carriage and wiping pens of the carriage with a carriage restraint in an engaged position and a wiper blade in an engaged position, according to one example of principles described herein.

FIG. 4B clearly illustrates the raising of the carriage restraint (104). More specifically, FIG. 4B depicts the carriage restraint lever (220). A first end (402) of the carriage restraint lever (220) is pivotally connected to the base (112). This reduces the tolerance stack up, such as mechanical fit and mechanical performance needs, with regard to the carriage. In other examples, the first end (402) of the carriage restraint lever (220) is pivotally connected to the frame (112). The carriage restraint lever (220) therefore pivots as indicated by arrow 810. The second end (404) of the carriage restraint lever (220) is coupled to a bottom end (408) of the carriage restraint (104). As the second rack (214) moves from a first position to a second position, the carriage restraint lever (220) makes contact and engages with a ramp (334). As the carriage restraint lever (220) engages with the ramp (334), the carriage restraint lever (220) pivots and allows the carriage restraint (104) to move up and down vertically between an engaged position and a disengaged position as indicated by arrow 808.

The movement of the second rack (214) also moves the wiper blade (108) into an engaged position. For example, as the second rack (214) moves from a first position to a second position, a slider ramp (410) interacts with the wiper blade mount (222). This interaction causes the wiper blade mount (222) to rotate as indicated by arrow 812. This rotation causes the wiper blade (108) to move to the engaged position as illustrated by arrow 814 in FIG. 4B. As a result, both the carriage restraint (104) and the wiper blade (108) move simultaneously to the engaged position.

Figure 5:
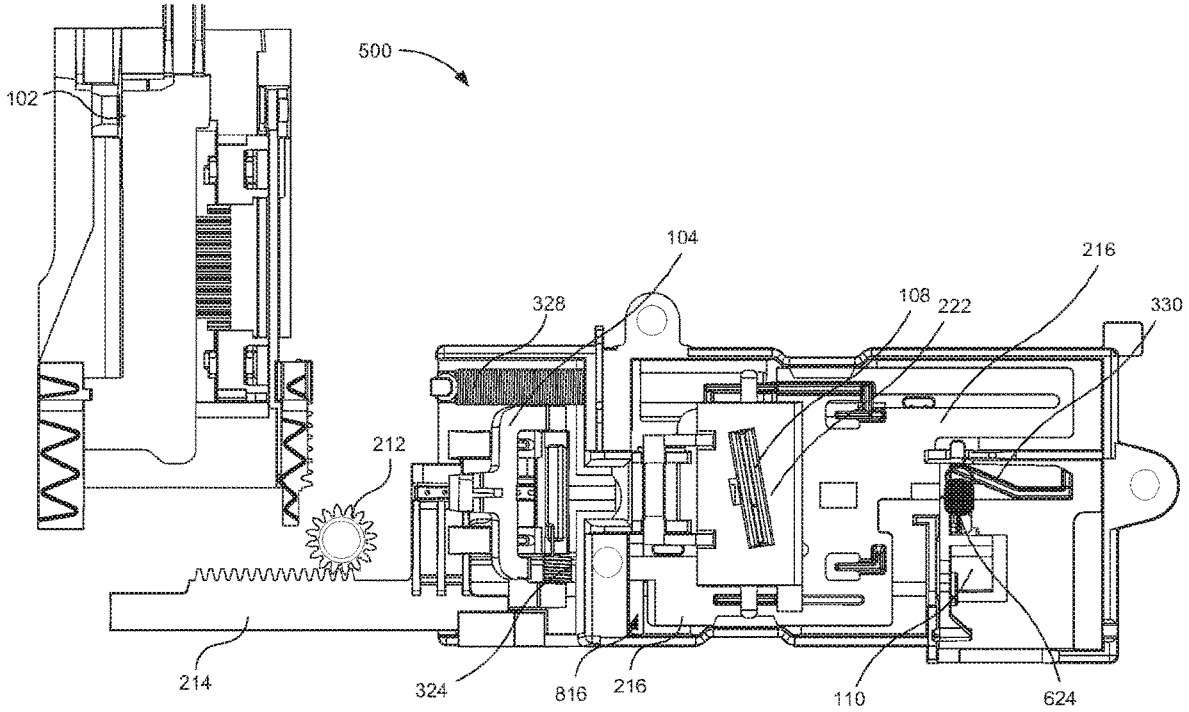
FIG. 5 is a top view of a system for restraining a carriage and for wiping pens of the carriage with the carriage restraint in a disengaged position and a wiper blade in an engaged position, according to one example of principles described herein.

FIG. 5 is a top view of a system for restraining a carriage and wiping pens with a carriage restraint in a disengaged position and a wiper blade in an engaged position, according to one example of principles described herein. As will be described below, a second rack is moved to a first position while the slider remains in a latched position.

As depicted in FIG. 5, the first rack (102) has moved to a backward position. As a result, the second rack (214) is in the first position. In the first position, the second rack (214) has removed the ramp (334) from under the carriage restraint (104). By removing the ramp (334) from under the carriage restraint (104), the carriage restraint (104) moves to the disengaged position. In this disengaged position, the carriage restraint (104) does not prevent the motion of the carriage.

However, because the second rack (214) is not connected to the slider (218) as indicated by arrow 816, the slider (216) is not affected by the second rack (214) moving to the first position because the latch (330) engages the trigger (110). This engagement of the latch (330) with the trigger (110) retains the slider (218) in a latched position. As a result, the slider ramp (410) remains under the wiper blade mount (222) and the wiper blade (108) remains in the engaged position.

As illustrated, with the slider (216) in the latched position, the slider retract spring (328) is fully extended. This provides tension between the interface of the trigger (110) and the latch (330). Once the trigger (110) disengages from the latch, the slider retract spring (328) moves the slider (216) from the latched position to an unlatched position. In the unlatched position, the slider retract spring (328) is in the relaxed position.

Figure 6A:
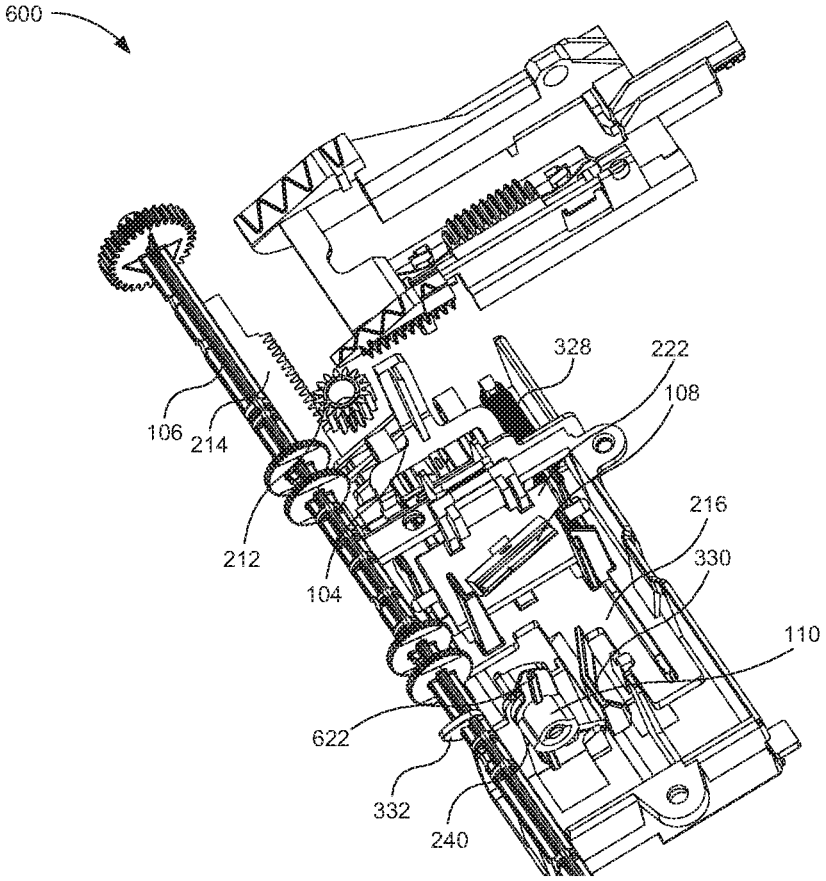
FIGS. 6A-6B are views of a system for restraining a carriage and for wiping pens of the carriage with a trigger disengaged from a latch, according to one example of principles described herein.

FIG. 6A is an isometric view of a system for restraining a carriage and wiping pens of the carriage with a trigger disengaged from a latch, according to one example of principles described herein.

FIG. 6A depicts the motion of the cam (332) which moves the wiper blade (108) from the engaged position to the disengaged position. More specifically, a shaft (106) with a cam (332) rotates and the cam (332) contacts a portion (240) of the trigger (110). This causes the trigger (110) to rotate. The pivot arm (622) of the trigger (110) moves upwards as illustrated in FIG. 6A to a vertical position and disengages from the latch (330). Since the slider retract spring (328) is in the tension position, the slider retract spring (328) retracts (328) the slider (218) to the unlatched position. In the unlatched position, the slider ramp (410) is removed from underneath the wiper blade mount (222). This causes the wipe blade (108) to move from the engaged position to the disengaged position. As a result, the carriage restraint (104) and the wiper blade (108) move from the engaged position to the disengaged position independently. Since the carriage restraint (104) and the wiper blade (108) move from the engaged position to the disengaged position independently, the carriage restraint (104) can be in the disengaged position while the wiper blade (108) is in the engaged position. With the carriage restraint (104) in the disengaged position and the wiper blade (108) in the engaged position, the carriage is free to move along the rod. This allows the wiper blade (108) to contact the pens for cleaning purposes without damaging the pens as the carriage moves along the rod as described above.

Figure 6B:
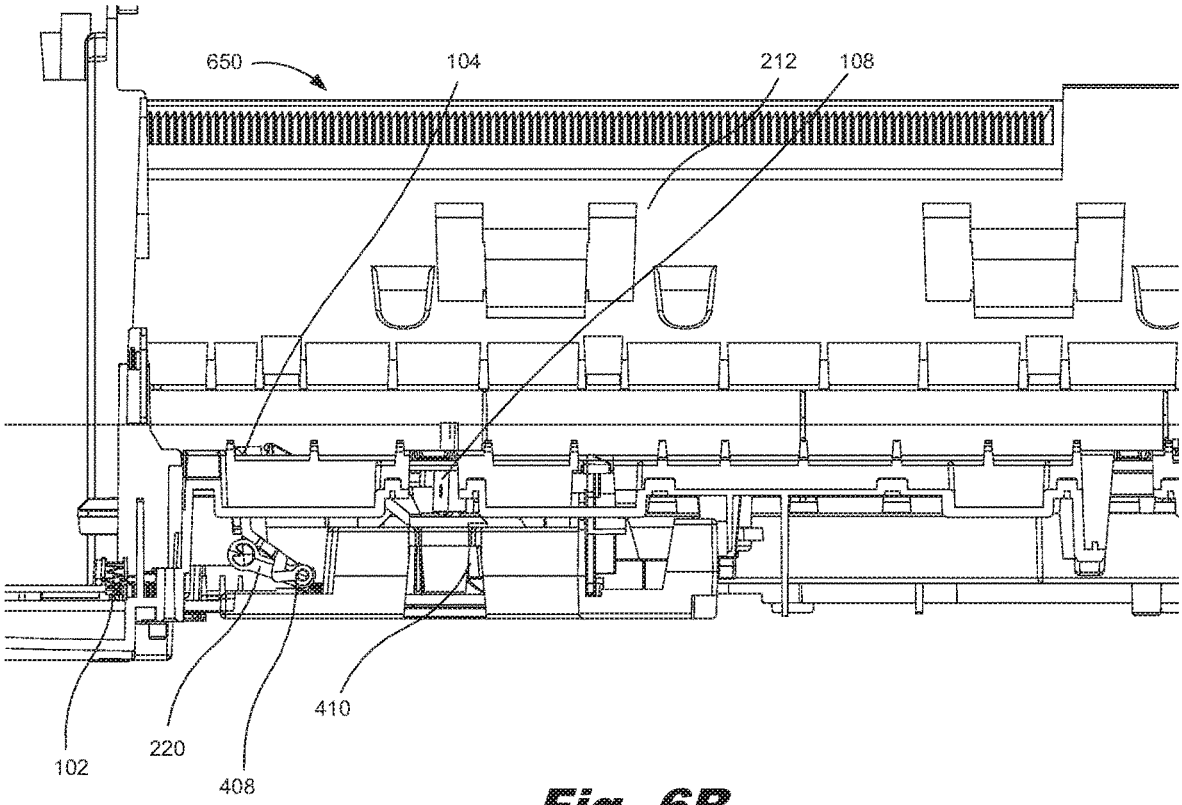

FIG. 6B is a cutaway side view of a system for restraining a carriage and wiping pens of the carriage with a carriage restraint in a disengaged position and a wiper blade in a disengaged position, according to one example of principles described herein. As will be described below, the carriage restraint and the wiper blade are in the disengaged positions.

As illustrated, the carriage restraint (104) and the wiper blade (108) are in the disengaged positions. This allows the printer to execute a print operation since the carriage is unrestrained and wiper blades (108) are not in contact with the printer pens. After the print job is completed, the carriage restraint (104) and the wiper blade (108) are moved from the disengaged positions of FIG. 6B to engaged positions as described above.

Figure 7A:
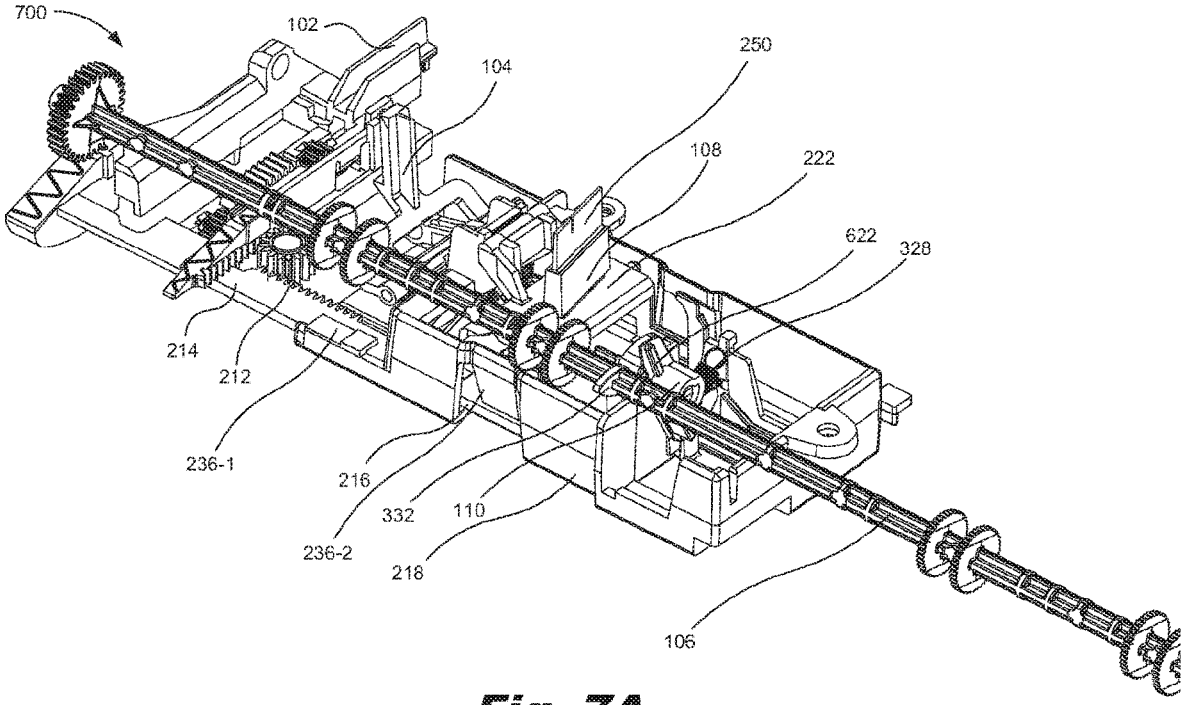
Figure 7B:
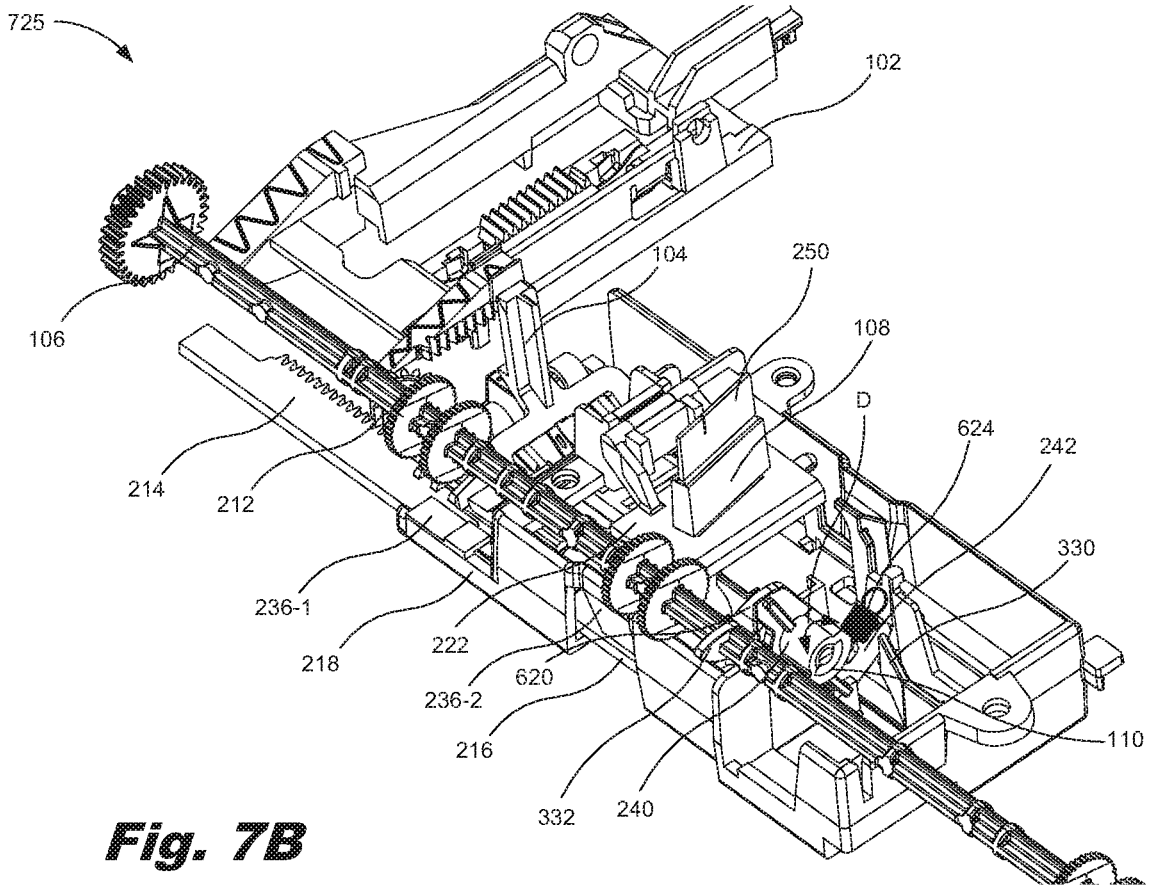

FIGS. 7A-7C are views of a system for restraining a carriage and for wiping pens of the carriage, according to one example of principles described herein. FIGS. 7A-7C illustrate the operation of the system.

Turning specifically to FIG. 7A, the first rack (102) is in a forward position. The resulting linear motion has moved the second rack (214) to a second position. In the second position, the carriage restraint (104) and the wiper blade (108) move from the disengaged position to the engaged position dependently as illustrated in FIG. 7A. In other words, as the carriage restraint (104) is moved from the disengaged position to the engaged position, the wiper blade (108) is moved from the disengaged position to the engaged position at the same time.

Turning specifically to FIG. 7B, the trigger (110) is pivotally secured to the frame (218) via a trigger mount (620). This allows the trigger (110) to pivot as indicated by arrow D. The trigger (110) includes a pivot arm (622). The pivot arm (622) pivots with the trigger (110) to engage the trigger (110) with the latch (330) when in a horizontal position or disengage the trigger (110) from the latch (330) when in a vertical position. For example, if the trigger (110) is rotated, for example, by the cam (332) of the shaft (106), the pivot arm (622) of the trigger (110) rotates as well. This rotation allows the pivot arm (622) of the trigger (110) to move to a vertical position and raise above the latch (330). As a result, the pivot arm (622) clears the latch (330). As a result, the trigger (110) is not engaged with the latch (216). However, when the portion (240) of the trigger (110) is not in contact with the cam, a trigger spring (624) forces the trigger (110) to rotate to the position of the trigger (110) as illustrated, in FIG. 7B. This maintains the pivot arm (622) in the horizontal position such that the trigger (110) is engaged with the latch (330).

As illustrated in FIG. 7C, the pivot arm (622) of the trigger (110) is rotated to a vertical position. In this vertical position, the pivot arm (622) of the trigger (110) is disengaged from the latch (322). As a result, the slider (218) moves to the unlatched position via the slider retract spring (328). In the unlatched position, the slider ramp (410) is removed from underneath the wiper blade mount (222) causing the wiper blade to move from the engaged position to the disengaged position.

Figure 8:
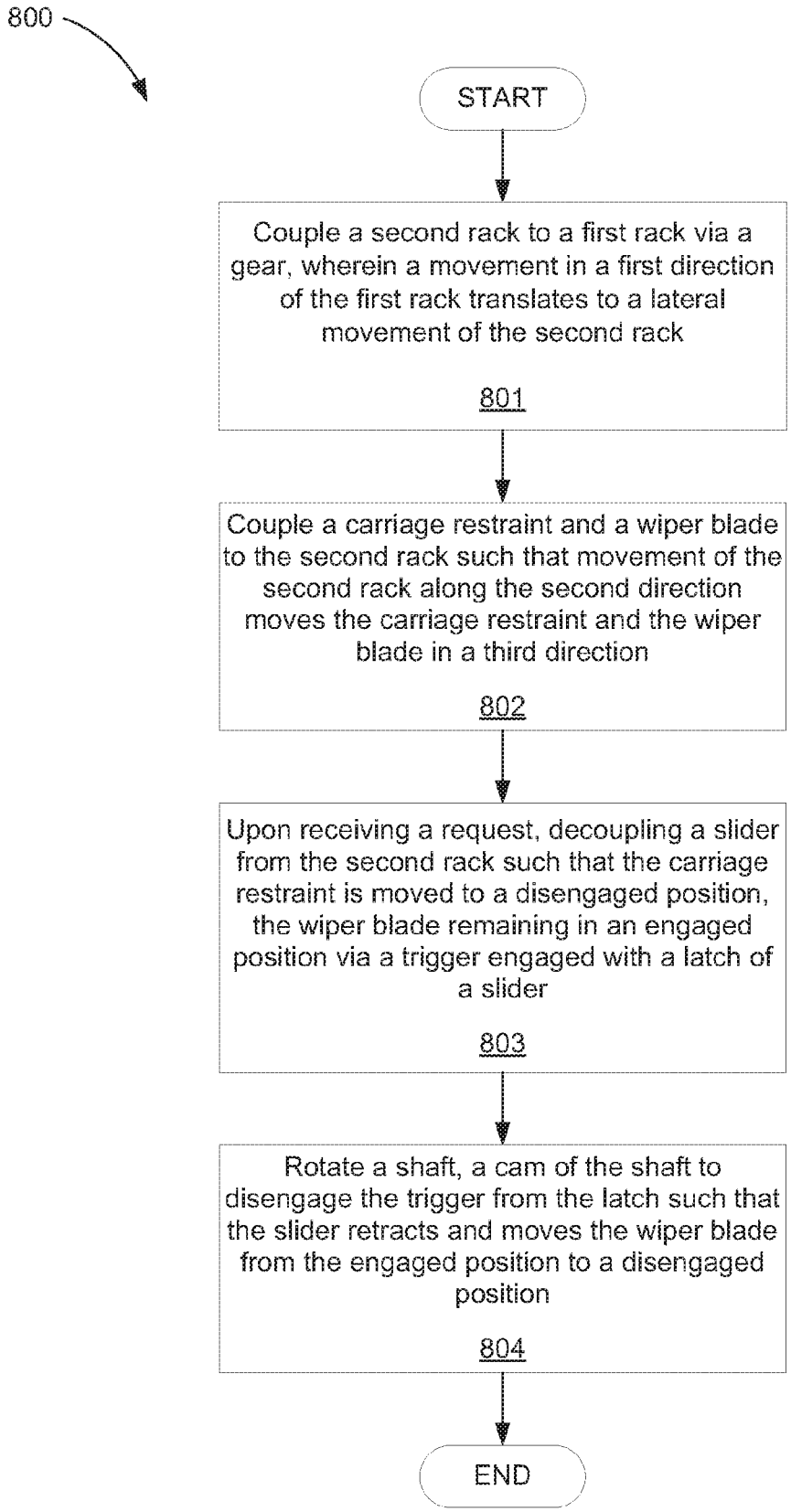
FIG. 8 is a flowchart a method for restraining a carriage, according to one example of principles described herein.
Figure 8:
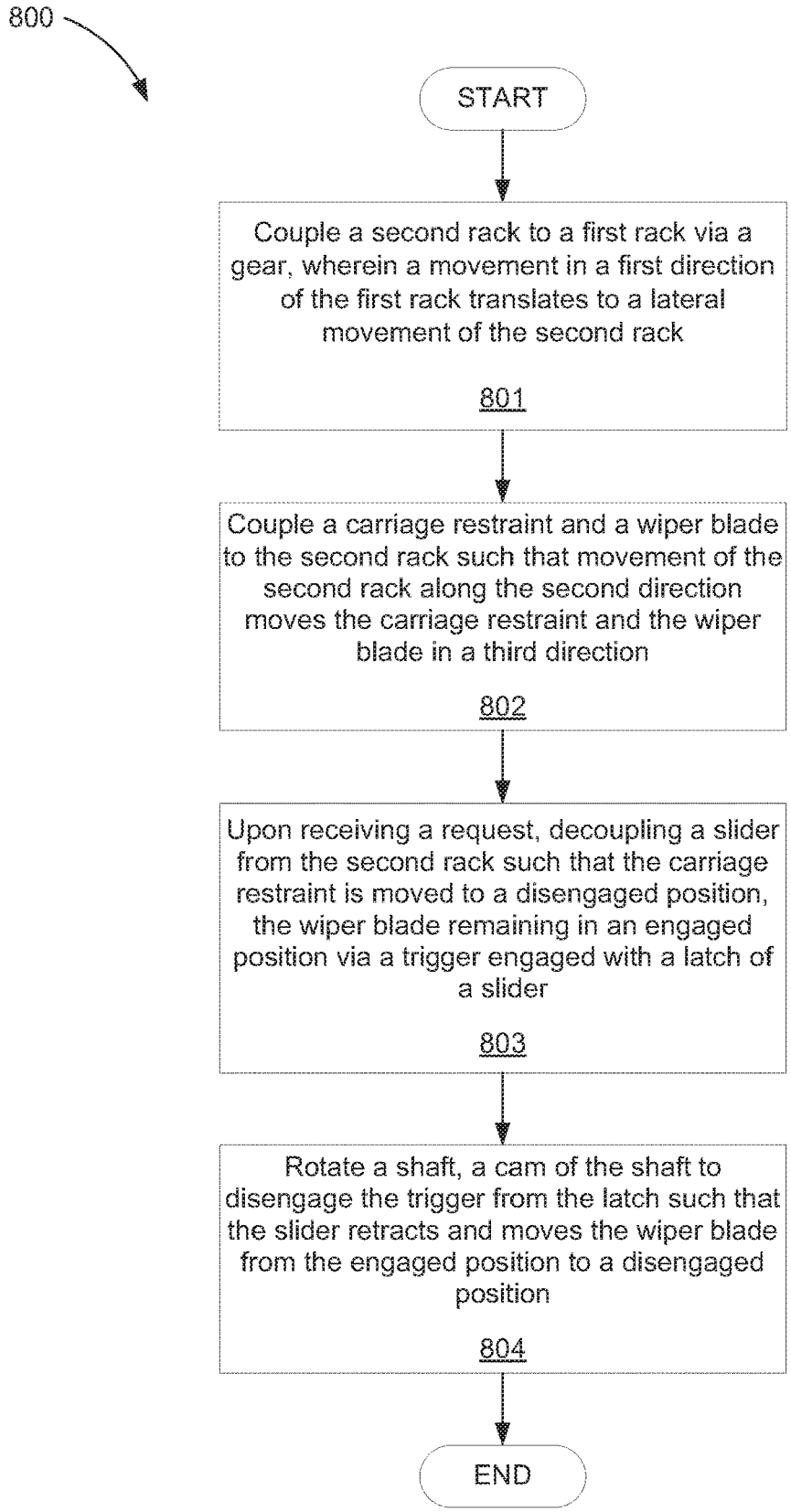

FIG. 8 is a flowchart a method (800) for restraining a carriage, according to one example of principles described herein. In an example, the method (800) includes coupling (801) a second rack to a first rack via a gear, wherein a movement in a first direction of the first rack translates to a lateral movement of the second rack. As mentioned above, the first rack and the second rack are set perpendicular to each other. As a result the first direction is perpendicular to the lateral movement.

In this example, the method (800) includes coupling (802) a carriage restraint and a wiper blade to the second rack such that movement of the second rack along the second direction moves the carriage restraint and the wiper blade in a third direction. In an example, the third direction includes moving the carriage restraint and the wiper blade from a disengaged position to an engaged position. In some examples, the carriage restraint is in the engaged position before and after a print job. In other examples, the carriage restraint is in the engaged position before shipping the printer to a consumer. As described above, this increases the reliability of the printer's carriage.

Further, the method (800) includes upon receiving a request, decoupling (803) a slider from the second rack such that the carriage restraint is moved to a disengaged position, the wiper blade remaining in an engaged position via a trigger engaged with a latch of a slider. In some example, the request may be to wipe the pens. As a result, the method (800) executes this step when the pens need to be cleaned.

In an example, a ramp coupled to the second rack moves as the second rack moves. As a result, the ramp moves the carriage restraint from the engaged position to the disengaged position.

In an example, a return spring (481) returns the carriage restraint from the engaged position to the disengaged position when the second rack is in a first position. In other examples, gravity returns the carriage restraint from the engaged position to the disengaged position when the second rack is in a first position.

As mentioned above, the method (800) includes rotating (704) a shaft, a cam of the shaft to disengage the trigger from the latch such that the slider retracts and moves the wiper blade from the engaged position to a disengaged position. In some examples, if the method (800) receives a print job and both the carriage restrain an the wiper blade are in the engaged position, the method (800) rotates the shaft to disengage the trigger from the latch, such that both the carriage restrain an the wiper blade are moved from the engaged positions to the disengaged positions at the same time. In other words, both the carriage restrain and the wiper blade are moved from the engaged positions to the disengaged positions dependently if needed.

The preceding description has been presented to illustrate and describe examples of the principles described. This description is not intended to be exhaustive or to limit these principles to any precise form disclosed. Many modifications and variations are possible in light of the above teaching.

What is claimed is:

1. A system for restraining a carriage, the system comprising:

a carriage restraint to secure the carriage of a printer, wherein the carriage restraint moves between an engaged position and a disengaged position;

a wiper assembly moveable between an engaged and disengaged position; and an engagement assembly to selectively move the carriage restraint and the wiper assembly to the engaged position;

wherein the engagement assembly further comprises a latch that selectively maintains the wiper assembly in the engaged position when the carriage restraint is moved to the disengaged position.

2. The system of claim 1, wherein the engagement assembly comprises:

a first rack coupled to a second rack via a gear, wherein movement of the first rack is transferred to the second rack via the gear; and a ramp coupled to the second rack, wherein as the second rack moves, the ramp moves the carriage restraint between the engaged position and the disengaged position.

3. The system of claim 2, wherein the gear translates movement of the first rack in a first direction to a movement of the second rack in a second direction to move the second rack between a first position and a second position.

4. The system of claim 2, wherein the engagement assembly further comprises a wiper engagement assembly, the wiper engagement assembly comprising:

a slider, the second rack pushing against the slider when the second racks moves from a first position to a second position;

a slider ramp coupled to the slider wherein the slider ramp moves the wiper assembly between the engaged position and the disengaged position; and the latch coupled to the slider, the latch engaging with a trigger to retain the wiper assembly in the engaged position.

5. The system of claim 4, wherein the trigger rotates about a pivot to engage or disengage the latch of the slider.

6. The system of claim 4, further comprising a shaft, a cam of the shaft to disengage the trigger from the latch such that the slider retracts and moves the wiper assembly from the engaged position to a disengaged position.

7. The system of claim 1, wherein the carriage of the printer is restrained when the carriage restraint is in the engaged position and the carriage of the printer is unrestrained when the carriage restraint is in the disengaged position.

8. The system of claim 1, wherein the engagement assembly moves the carriage restraint and a wiper blade of the wiper assembly to the engaged position simultaneously.

9. The system of claim 1, wherein the engagement assembly further comprises a trigger to release the latch such that the wiper assembly then moves from the engaged position to the disengaged position.

10. The system of claim 1, wherein the wiper assembly comprises a wiper blade to wipe pens on the carriage.

11. The system of claim 1, wherein the carriage restraint is in the engaged position before and after a print job.

12. A system for restraining a carriage, the system comprising:

a carriage restraint to secure the carriage of a printer, the carriage restraint to move between an engaged position and a disengaged position;

an engagement assembly to selectively move the carriage restraint between the engaged position and the disengaged position;

a second rack coupled to a first rack via a gear, wherein a movement in a first direction of the first rack translates to a lateral movement of the second rack in a second direction;

the carriage restraint and a wiper blade coupled to the second rack such that movement of the second rack along the second direction moves the carriage restraint and the wiper blade in a third direction; wherein, upon receiving a request, a slider is to decouple from the second rack such that the carriage restraint is moved to a disengaged position, the wiper blade remaining in an engaged position via a trigger engaged with a latch of a slider; and a shaft, a cam of the shaft to disengage the trigger from the latch to retract the slider retracts and move the wiper blade from the engaged position to a disengaged position.

13. The system of claim 12, wherein the carriage restraint is moveable between an engaged position and a disengaged position via a ramp connected to the second rack.

14. The system of claim 13, wherein the carriage restraint is in the engaged position before and after a print job.

15. The system of claim 13, further comprising a return spring to return the carriage restraint from the engaged position to the disengaged position when the second rack is in a first position.

16. The system of claim 12, wherein the second rack moves the wiper blade into the engaged position by pushing against the slider, a slider ramp of the slider moving the wiper blade into the engaged position.

17. A system for restraining a carriage, the system comprising:

a carriage restraint moveable between an engaged position and a disengaged position to selectively secure a carriage of a printer;

a wiper assembly moveable between an engaged position and a disengaged position, the wiper assembly comprising a wiper blade to wipe pens on the carriage when the wiper assembly is in the engaged position and the carriage moves past the wiper assembly; and an engagement assembly mechanically coupled to the carriage restraint and the wiper assembly, wherein action of the engagement assembly simultaneously moves the carriage restraint and the wiper assembly to the engaged position, wherein the engagement assembly further comprises a latch to selectively maintain the wiper assembly in the engaged position when the carriage restraint is moved to the disengaged position.

18. The system of claim 17, further comprising a return spring to return the carriage restraint to the disengaged position.

19. The system of claim 17, further comprising a slider retract spring to retract a slider to disengage the latch to allow the wiper assembly to return to the disengaged position.

* * * * *